United States Patent [19]

McVeigh et al.

[11] 4,343,006

[45] Aug. 3, 1982

[54] HIGH ACCURACY FEEDBACK CONTROL SYSTEM FOR A PHASED ARRAY ANTENNA

[75] Inventors: Peter J. McVeigh, Hauppauge; Ronald M. Rudish, Commack, both of N.Y.

[73] Assignee: Eaton Corporation, Cleveland, Ohio

[21] Appl. No.: 182,166

[22] Filed: Aug. 28, 1980

[51] Int. Cl.[3] ..... H01Q 3/26

[52] U.S. Cl. ..... 343/854; 343/100 SA

[58] Field of Search ..... 343/100 SA, 100 TD, 343/854, 853, 777, 778

[56] References Cited

U.S. PATENT DOCUMENTS 4,276,551 6/1981 Williams et al. ..... 343/100 SA 4,314,250 2/1982 Hanell et al. ..... 343/100 SA

*Primary Examiner*—David K. Moore

*Attorney, Agent, or Firm*—Kevin Redmond

[57] ABSTRACT

A plurality of antenna elements in a phased array are arranged to be supplied in serial fashion by means of couplings spaced along a distribution system. A plurality of phase shifters are placed in series within the distribution system with one shifter being located prior to each coupling to control the phase supplied to the elements and thereby control the direction of the radiated beam. Samples of the signal to be transmitted are taken at the input and output of the distribution system and compared to determine the total phase shift through the system. The total phase shift is then compared to a desired total phase shift to generate an error signal which is applied to the phase shifters to produce the total desired phase shift and thus accurately steer the beam to a desired spatial angle.

6 Claims, 3 Drawing Figures

HIGH ACCURACY FEEDBACK CONTROL SYSTEM FOR A PHASED ARRAY ANTENNA

BACKGROUND

1. Field

This invention relates to beam steering of a phased array antenna and, in particular, to steering control systems in which the total phase shift to the signal applied to the antenna elements is sensed and adjusted by means of feedback circuitry to accurately control the beam direction.

2. Prior Art

Phased array antennas generally comprise a plurality of antenna elements in which the phase of the signal supplied to each element is controlled by one or more phase shifters. Commonly, the phase shifters are controlled by open-loop commands. That is, manual or automatic means sends a commanded steering angle to a unit, usually referred to as a beam steering computer. This unit generates instructions for the phase shifters. These instructions, when executed, cause a transmitted signal to be radiated in a beam with nominally the desired beam pointing direction. No feedback of actual beam pointing direction occurs so that pointing errors caused by errors in producing the required phase shifts are undetected and are not compensated.

High accuracy beam pointing control has been obtained in closed-loop tracking systems. In the case of a radar application, a measure of the reflecting object's angular displacement from the beam boresight direction is fed back to the beam steering computer. This enables corrections to be computed for the phase shifter instructions so that the beam boresight direction is brought into alignment with the direction to the reflecting object. Similarly, in the case of a full-duplex communications application, a measure of the first party's beam displacement from perfect alignment is obtained by the second party and is communicated back to the first party. This allows the first party to correct the phase shifter settings and thus the beam pointing angle. In both these applications external aids to sensing the pointing error are required; that is, the presence of a concentrated target in the radar case and the cooperation of a second party in the communications case. This lack of self-sufficiency is a disadvantage.

Another type of prior art system which is self-sufficient and which employs a type of internal feedback is shown in FIG. 1. In this system, the signal to be applied to the antenna elements is first supplied to an antenna distribution system 112 at port 101 where it is then passed through a series of phase shifters 103A through 103D along the distribution system. The signal is coupled to the antenna elements 104A through 104D by means of couplers 105A through 105D which are spaced along the distribution system between the phase shifters. Each coupler is equipped with a termination to absorb reflections and an attenuator to aid in matching the elements to the distribution system.

In the operation of this system, the signal to be transmitted is applied to the antenna element by way of the distribution system, phase shifters and couplers. The phase shifters are identical and each receives the same control signal. Accordingly, each imparts the same phase shift to the signal in the distribution system. The signal arriving at any one antenna element is shifted in phase with respect to the previous element along the distribution system by the phase shift of a single phase shifter. This is the requirement for steering the beam off boresight by a spatial angle which is directly related to the phase angle imparted by each phase shifter.

Phase shifters 109 and 113 and phase detector 106 comprise the control circuitry which sets and corrects the angle of the phase shifter 103A through 103D and thus controls the beam direction. In the operation of this circuitry, a command signal applied to port 114 sets phase shifter 113 to a particular phase shift setting corresponding to the desired beam steering angle. A signal at the same frequency as the signal to be transmitted is applied to the port 108, divided and passed through the phase shifters 109 and 113 to the input ports of phase detector 106. The output of phase detector 106 is passed through phase shifter control loops 107A through 107D and 110 to control the phase shift of shifters 103A through 103D and 109, setting them all to the same angle.

The phase of the signals arriving at the input ports of the phase detector will have the same phase angle if phase shifter 109 is at the same angle as phase shifter 113. This condition will result in zero output from the phase detector. If all the phase shifters are of the latching type, they will continue to shift in phase until the control signal goes to zero. Since phase shifter 109 is chosen to be identical to phase shifters 103A through 103D, all of these phase shifters will be continually shifted in phase by the output of the phase detector until their phase is equal to that of phase shifter 113, which is set to the desired phase.

The feedback in this circuit is provided by means of a "dummy" phase shifter 109 which is assumed to be at the same phase angle as phase shifters 103A through 103D when the system is at rest because all receive the same control signal; however, as a practical matter, there are differences caused by manufacturing tolerances and different environmental conditions. In addition, the nonuniformities in the antennas produce different reflections which result in different phase shift between the dummy phase shifter 109 and those used to control the beam direction. As a result, there is no feedback to the control circuit or correction of the actual phase shift imparted by the beam steering phase shifters 103A through 103D.

SUMMARY

In the present invention, the actual total phase shift produced by phase shifters along a phased array antenna distribution system is measured and compared with the desired phase shift in order to produce an error signal which is applied to correct the phase shift produced by the individual phase shifters.

The total phase shift is directly related to the actual beam direction and therefore the present invention, unlike prior art systems, will accurately control and make necessary corrections to the beam direction to compensate for environmental factors, manufacturing tolerances and reflections along the distribution system.

DETAILED DESCRIPTION OF THE INVENTION

Figure 1:
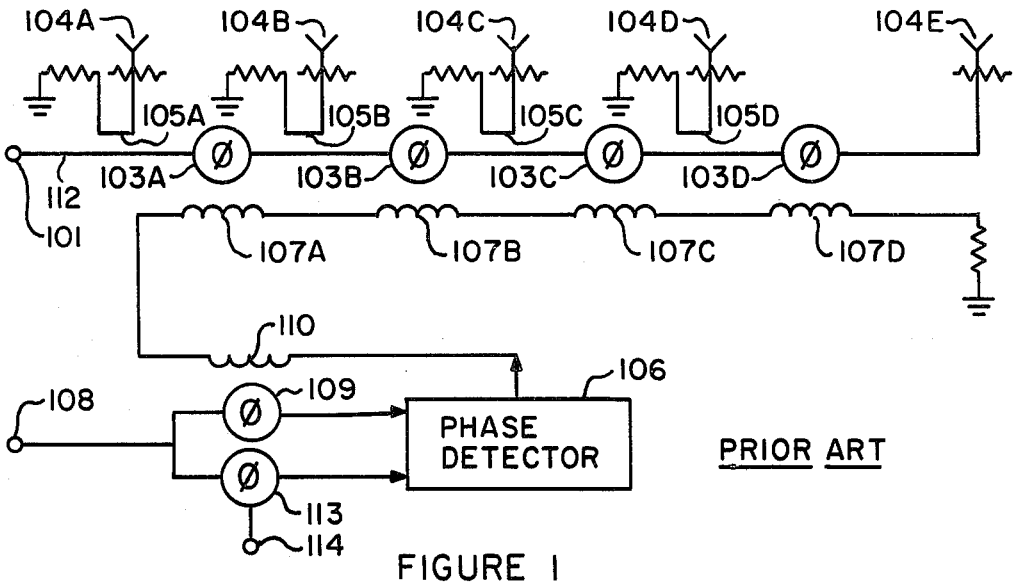
FIG. 1 is a diagram of a prior art phased array control and distribution system, wherein feedback is provided by means of a dummy phase shifter.
Figure 2:
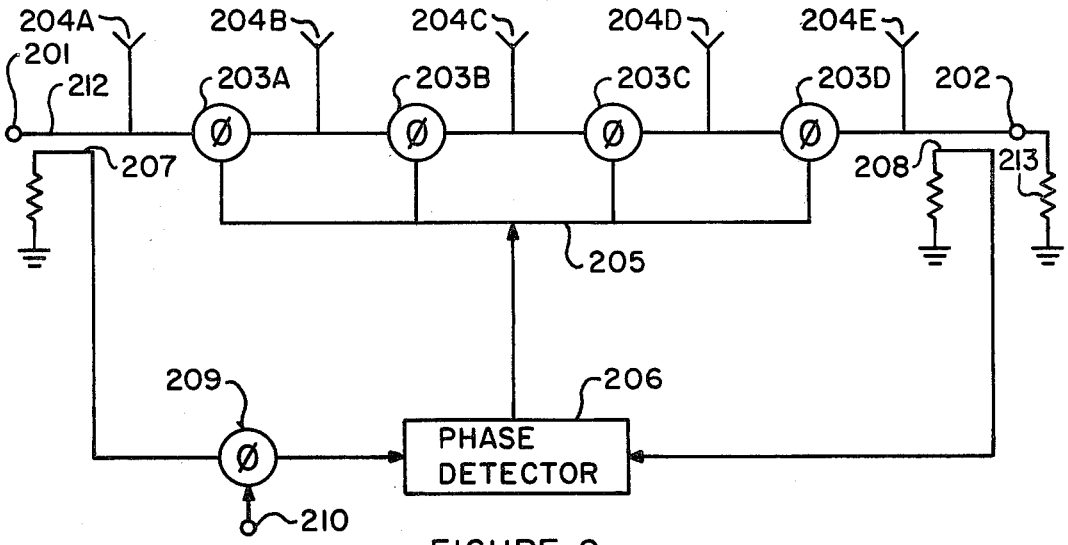
FIG. 2 is a diagram of a first embodiment of the present invention, wherein the desired beam direction is entered into the system by means of a reference phase shifter.

FIG. 2 illustrates a first embodiment of the present invention. The distribution system, phase shifters, and method of supplying the antenna elements are similar to that of FIG. 1; however, the control system is significantly different.

The signal to be applied to the antenna element is first received by the antenna distribution system 212 at port 201, where it is passed along the distribution system and through a series of phase shifters 203A through 203D to a termination 213 located at the end 202 of the distribution system. The signal is coupled to the antenna element 204A through 204D by individual couplers positioned along the distribution system between phase shifters.

In the operation of this system, the signal to be transmitted is supplied to the antennas by way of the distribution system and phase shifters. The phase shifters are identical with each receiving the same control signal and accordingly imparting the same phase shift. The signal arriving at any antenna element is shifted in phase with respect to the previous element along the distributing system by the phase shift of a single phase shifter. As noted earlier, this is the requirement for steering the beam off boresight by a spatial angle which is directly related to the phase angle imparted by each phase shifter.

The control and feedback circuitry of FIG. 2 comprises directional coupler 207 located at the input of the distribution system, directional coupler 208 located at the end of the distribution system, phase detector 206 which receives the output of the directional couplers and phase shifter 209 which is in series with one input of the phase detector. In the operation of the control circuitry, a command signal indicating the desired total phase shift across the phase shifters 203A through 203D, is applied to the control port 210 of phase shifter 209. A portion of the signal applied to the distribution system is coupled through directional coupler 207 and passed through phase shifter 209 to a first input port of phase detector 206. A portion of the signal at the end 202 of the distribution system is coupled through directional coupler 208 to the second input port of phase detector 206. The output of phase detector 206 supplies the control signal to phase shifters 203A through 203D through line 205.

The operation of the control circuitry shown in FIG. 2 is dependent on the type of phase shifter used. There are two types of electronically controlled phase shifters in common use. The first is the latching phase shifter which is typically a ferrite device. In this type of shifter the phase is continuously changed as long as the control signal is applied. The phase stops shifting when the signal is discontinued.

The second type of phase shifter is the nonlatching phase shifter which is typically a varactor phase shifter in which the phase shift is dependent upon the magnitude of the applied control voltage.

If the phase shifters 203A through 203D are all of the latching type, the output of phase detector 206 will cause them to continually shift phase until the total phase shift through all the phase shifters in the distribution system is equal to the phase shift of phase shifter 209, which is set by the command signal to the desired total phase angle. At this point, the phase of the signals reaching the input ports of the phase detector will be equal. This will cause the output of the phase detector to drop to zero and the phase shifters to stop shifting when they have reached the desired total phase shift.

Although not shown as separate components, all systems illustrated in the Figures are considered as having the usual amplification, buffering and shaping networks contained within components such as the phase detector, to drive the phase shifter to the desired position as is normally required in a feedback control circuit.

Where a nonlatching phase shifter is used, the feedback operation is similar to the operation with a latching phase shifter, except a slight offset from zero output from the phase detector will be amplified by amplifiers within the phase detector to set the phase shifter 203A through 203D to the desired phase angle. The stable point for this feedback system occurs where the total phase shift across 203A through 203D is essentially at the desired phase angle.

Usually phase detectors are operative over an input phase difference of 360 degrees or less. Where the change in phase through the phase shifter 202A through 202D due to a command signal is greater than 360 degrees, the phase detector will only recognize this change in phase less an integral number of 360 degree shifts sufficient to reduce the remainder to less than 360 degrees. There is a problem in controlling or recognizing the integral number of 360 degree shifts made to reduce this remainder to less than 360 degrees.

This problem may be overcome in a number of ways. One is to gradually change the command signal so that the command signal never differs from the actual total phase shift by more than 360 degrees. In this way, the integral number of 360 degree changes made is controlled. Another way is to monitor the phase shift through one of the phase shifters in the distribution system 202A through 202D. This phase shift multiplied by the total number of phase shifters in the distribution system provides a course indication of the total phase shift and therefore indicates the integral number of 360 degree phase shifts made.

Figure 3:
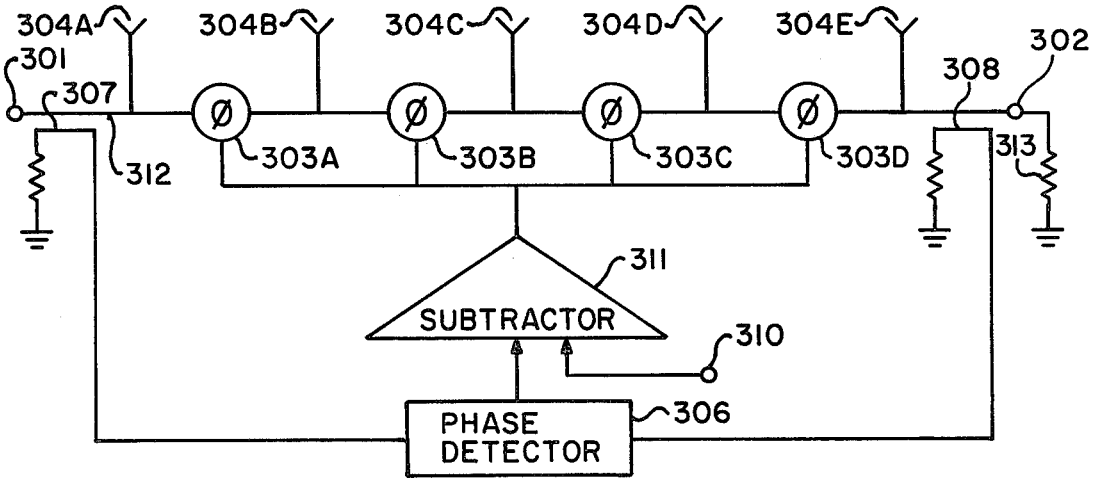
FIG. 3 is a diagram of a second embodiment of the present invention, wherein the desired beam direction is entered into the system by means of a command signal applied to a subtractor.

FIG. 3 illustrates a second embodiment of the present invention. The distribution system phase shifters, and method of supplying the antenna elements are identical to those shown in FIG. 2; however, the control system used in FIG. 3 is significantly different.

The signal to be applied to the antenna element is first received by the antenna distribution system 312 at port 301, where it is then passed along the distribution system and through a series of phase shifters 303A through 303D to a termination 313 located at the end 302 of the distribution system. The signal is coupled to the antenna element 304A through 304D by individual couplings positioned along the distribution system between phase shifters.

In the operation of this system, the signal to be transmitted is supplied to the antennas by way of the distribution system and phase shifter. The phase shifters are identical, with each receiving the same control signal and, accordingly, imparting the same phase shift. The signal arriving at any antenna element is shifted in phase with respect to the previous element along the distributing system by the phase shift of a single phase shifter.

The control and feedback circuitry of FIG. 3 comprises directional coupler 307 located at the input of the distribution system, directional coupler 308 located at the end of the distribution system, phase detector 306 which receives the output of the directional couplers, and subtractor 311 which receives the output of the phase detector.

In the operation of the control circuitry, a command signal indicating the desired total phase shift across the phase shifters 303A through 303D in series, is applied to port 310 of the subtractor 311. A portion of the signal applied to the distribution system is coupled through directional coupler 307 to a first input port of phase detector 306. A portion of the signal at the end 302 of the distribution system is coupled through directional coupler 308 to the second input port of phase detector 306. The output of phase detector 306 is supplied to one input port of subtractor 311.

If the phase shifters 303A through 303D are all of the latching type, the output of subtractor 311 will cause them to continually shift phase until the total phase shift through all the phase shifters in the distribution system is equal to the phase shift indicated by the command signal applied to port 310 of the subtractor. At this point, the phase of the signals reaching the input ports of the phase detector will differ by the total desired phase shift indicated by the command signal. This will result in the output of the phase detector being equal to the command signal, the output of the subtractor dropping to zero, and the phase shifters terminating shifting at the desired total phase shift.

Where a nonlatching phase shifter is used, the feedback operation is similar to the operation with a latching phase shifter except a slight offset from zero output from the subtractor will be amplified by amplifiers within the subtractor to set the phase shifter 303A through 303D to the desired phase angle. The stable point for this feedback system occurs where the total phase shift across 303A through 303D is essentially at the desired phase angle.

It is important to note that the beam direction is exactly determined by the average phase angle of the individual phase shifters in the distribution system and that the total phase angle, which is a direct indication of the average phase angle and beam direction, is accurately controlled in the present invention.

It is also important to note that many equivalents are within the scope of the invention. For example, a digital phase detector and a digital subtractor may be substituted for the analog types shown and the digital output of these components may be applied to drive digital phase shifters directly without there being any significant departure from the present invention as shown and described herein.

Having described the invention, we claim:

1. Apparatus for accurately controlling the pointing direction of a phased array antenna, comprising:

(a) means for distributing a first signal to a plurality of antenna elements in series, said means for distributing having an input and an output port, (b) a plurality of first means for shifting phase of the first signal, each of said means for shifting phase having an input, an output and a control port and each being positioned between antenna elements in series along said means for distributing to accept the first signal at its input port and transmit the first signal from its output port with a phase shift determined by a second signal applied to its control port, (c) first means for sampling a portion of the first signal connected to the input port of the means for distributing, (d) second means for sampling a portion of the first signal connected to the output port of the means for distributing, (e) means for sensing phase having first and second input ports and an output port, the first input port being connected to the first means for sampling while the second output port is connected to the second means for sampling to accept and determine the phase difference between the samples of the first signal and produce at the output port of the means for sensing phase the second signal indicating the phase difference of the sampled signals, said second signal being applied to control the phase shift of the plurality of first means for shifting the phase, and (f) second means for shifting phase designated the reference phase shifting means having an input port and output port and a control port, the second means for shifting the phase connected in series between one of the means for sampling and the means for sensing the phase to shift the phase of one of the sampled signals in accordance with a third signal designated the command signal which indicates the desired total phase shift of the plurality of first means for shifting phase, said command signal being applied to the control port of the reference phase shifting means to set its phase and the total phase of the plurality of means for shifting phase by way of the means for sensing phase.

2. Apparatus as claimed in claim 1, wherein the means for shifting the phase is of the nonlatching type which produces a phase shift related to the amplitude of the control signal and said means for sensing the phase produces a second signal with an amplitude to set the total phase shift of the plurality of first means for shifting the phase at the phase indicated by the command signal.

3. Apparatus as claimed in claim 1, wherein said plurality of first means for shifting the phase is of the latching type in which the phase continues to shift as long as there is a control signal applied and ceases to shift as soon as the control signal is removed and said means for sensing the phase continues to produce an output signal until the total phase shift of the plurality of first means for shifting the phase is equal to the phase indicated by the command signal.

4. Apparatus for accurately controlling the pointing direction of phased array antenna, comprising:

(a) means for distributing a first signal to a plurality of antenna elements in series, said means for distributing having an input and an output port, (b) a plurality of means for shifting phase of the first signal, each of said means for shifting phase having an input, an output and a control port and each being positioned between antenna elements in series along said means for distributing to accept the first signal at its input port and transmit the first signal from its output port with a phase shift determined by a second signal applied to its control port, (c) first means for sampling a portion of the first signal connected to the input port of the means for distributing, (d) second means for sampling a portion of the first signal connected to the output port of the means for distributing, (e) means for sensing phase having first and second input ports and an output port, the first input port being connected to the first means for sampling while the second input port is connected to the second means for sampling to accept and determine the phase difference between the samples of the first signal and produce at the output port of the means for sensing phase a third signal indicating the phase difference of the sampled signals, (f) means for subtracting two signals, said means for subtracting having two input ports and an output port and accepting at one input port a signal designated the command signal which indicates the total desired phase shift of the plurality of means for shifting the phase and accepting at the second input port the third signal indicating the present phase of the total phase shift of the plurality of means for shifting phase to produce at the output of the means for subtracting the second signal which is applied to the control ports of the plurality of means for shifting the phase to drive them to produce the total phase shift indicated by the command signal.

5. Apparatus as claimed in claim 4, wherein the means for shifting the phase is of the nonlatching type which produces a phase shift related to the amplitude of the control signal and said means for subtracting produces a second signal with an amplitude to set the total phase shift of the plurality of means for shifting the phase at the phase indicated by the command signal.

6. Apparatus as claimed in claim 4, wherein said plurality of means for shifting the phase is of the latching type in which the phase continues to shift as long as there is a control signal applied and ceases to shift as soon as the control signal is removed and said means for subtracting continues to produce an output signal until the total phase shift of the plurality of means for shifting the phase is equal to the phase indicated by the command signal.

* * * * *